US006098981A

United States Patent [19]

Schuetter

[11] Patent Number: 6,098,981

[45] **Date of Patent: *Aug. 8, 2000**

[54] END-TO-END BOARD GAME

[76] Inventor: Ken Schuetter, 1810 W. 5th Ave., Jasper, Ind. 47546

[ * ] Notice: This patent issued on a continued prosecution application filed under 37 CFR 1.53(d), and is subject to the twenty year patent term provisions of 35 U.S.C. 154(a)(2).

[21] Appl. No.: 09/086,929

[22] Filed: May 29, 1998

[51] Int. Cl.[7] ..... A63F 3/00

[52] U.S. Cl. ..... 273/243; 273/275; 273/276

[58] Field of Search ..... 273/275, 276, 273/249, 243, 282.1; 434/204, 207, 208

[56] References Cited

U.S. PATENT DOCUMENTS

| | | | |
|---|---|---|---|
| D. 27,443 | 7/1897 | Kogler . | |
| 2,188,480 | 1/1940 | Murray | 273/130 |
| 3,193,293 | 7/1965 | Schaper | 273/135 |
| 3,402,934 | 9/1968 | Adams | 273/156 |
| 3,460,835 | 8/1969 | Crans | 273/135 |
| 3,695,616 | 10/1972 | Weber . | |
| 4,032,151 | 6/1977 | Morse . | |
| 4,752,227 | 6/1988 | Yamin | 434/110 |
| 5,026,071 | 6/1991 | Miraglia . | |
| 5,497,997 | 3/1996 | Nikas et al. | 273/264 |

*Primary Examiner*—William M. Pierce
*Attorney, Agent, or Firm*—Woodard, Emhardt, Naughton, Moriarty & McNett

[57] ABSTRACT

An educational game including a flat game board with a number of equally-long slots formed therein, several sets of dowels of varied lengths, each set having its own color, and a means, such as a die or spinner, for randomly selecting a particular set from which to withdraw a dowel and place it into a slot. The game is played by a number of players, each having a slot to fill, taking turns rolling the die and placing a dowel of the selected color into the slot. The die may also mandate the removal of the player's last dowel placed into the slot or the relocation of an opponent's last dowel from their slot into the player's slot. The first player to exactly fill their slot wins the game.

16 Claims, 4 Drawing Sheets

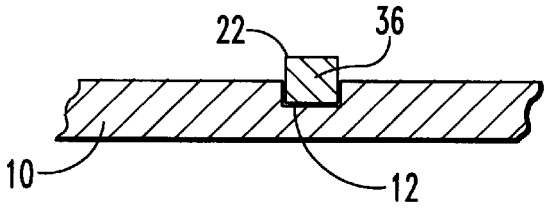
Fig. 3
Fig. 2
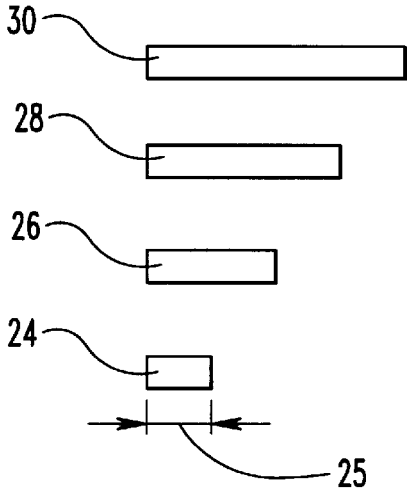
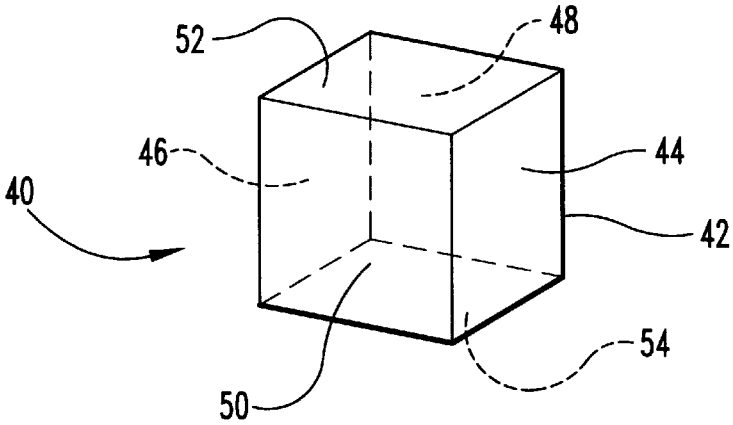
Fig. 4

END-TO-END BOARD GAME

This invention relates to board games and more specifically relates to educational games for learning colors, spatial relationships, and strategy.

BACKGROUND OF THE INVENTION

It is important to learn basic concepts such as color differentiation, simple spatial relationships, how to follow simple directions, and how to deal with setbacks in a mature and sportsmanlike manner. As these simple skills are mastered, more complex skills may be acquired, such as how to plan competitive strategies and how to take advantage of opportunities as they present themselves.

One way of acquiring such basic skills is through the playing of educational games that make the learning process fun and entertaining. Games developed toward this end include U.S. Pat. No. 2,188,480 issued on Jan. 30, 1940 to Murray; U.S. Pat. No. 3,193,293 issued on Jul. 6, 1965 to Schaper; U.S. Pat. No. 3,402,934 issued on Sep. 24, 1968 to Adams; U.S. Pat. No. 3,460,835 issued on Aug. 12, 1969 to Crans; U.S. Pat. No. 3,695,616 issued on Oct. 3, 1972 to Weber; U.S. Pat. No. 4,129,303 issued on Dec. 12, 1978 to Flagg; and U.S. Pat. No. 5,497,997 issued on Mar. 12, 1996 to Nikas et al. However, none of these games or devices effectively combine the teaching of colors, spatial relationships, and strategy with simple, easy to comprehend instructions. Hence, there is a need for an improved educational board game capable of teaching colors, spatial relationships, strategy and sportsmanship and of being easily understood and played by anyone, including young children. A means for satisfying this need has so far eluded those skilled in the art.

SUMMARY OF THE INVENTION

In one aspect, this invention is a game for teaching simple directions, color differentiation, simple spatial relationships between objects having fixed dimensions, and strategic planning. The game includes a flat game board with slots recessed into the surface, a plurality of dowels of various lengths and colors, and a randomized dowel selection means, such as a die or a spinner. The slots have equal lengths, and are sized to accept a number of the dowels. The game also includes a number of different colored dowels organized into dowel sets, each set comprising dowels of a singular length and color. The dowel length ratios are also fixed as integral multiples of the shortest dowel length.

In one preferred embodiment of the present invention, the game board includes four recessed slots of equal lengths beginning at the corners and terminating near the middle of the board. This preferred embodiment also includes four sets of dowels adapted to rest in the slots. The dowels in this embodiment are wooden with rectangular cross-sections. The dowel sets are differentiated by dowel length and color. In this preferred embodiment, red dowels are one unit long, yellow dowels are two units long, green dowels are three units long, and blue dowels are four units long. The slots are 34 units long. In this preferred embodiment, a unit is chosen to be one centimeter. This preferred embodiment also includes a six-sided die as the dowel selection means. Four of the sides have colors matching those of the dowel sets, red, yellow, green, and blue, respectively. The other two sides are black and white, respectively.

The method of playing the game is very simple, since the game is intended as a learning tool for young children. In the above-described preferred embodiment, the game is played by each player in turn rolling the die. If one of the four dowel set colors comes up, the player adds a dowel of that color to his slot. If black comes up, the player removes the last dowel added to his slot. If white comes up, the player may take the last dowel added to another player's slot and place it in his own slot. If the dowel to be added to his slot exceeds the remaining empty space available in the slot, the player does not place a dowel into the slot and the next player then takes his turn. Play moves sequentially from player to player until one player completely fills his slot, winning the game.

In some embodiments, the game board is flexible. In these embodiments, the game board may be made from a sheet of vinyl or rubber.

In other embodiments, the slots are painted on the game board. In these embodiments, the dowels are not constrained to fit within the slots.

In still other embodiments, there are more than four slots in the game board. In these embodiments, the slots are positioned conveniently around the board.

In yet other embodiments, there are different numbers of dowel sets, each having a different length and corresponding color. In these embodiments, the dowel selection means will be adapted to accommodate the number of dowel sets with equal probability of selection.

In still other embodiments, the rules are varied to increase or decrease the strategic options available to the players.

BRIEF DESCRIPTION OF THE DRAWINGS

FIG. 2 plan view of dowels used with the game board embodiment shown in FIG. 1.

FIG. 3 is a cross-sectional view of a dowel resting in a slot of the game board embodiment of the present invention shown in FIG. 1.

FIG. 4 is an isometric view of a six-sided die used with the game board embodiment of the present invention shown in FIG. 1.

DETAILED DESCRIPTION OF THE PREFERRED EMBODIMENT

Specific language is used in the following description and examples to publicly disclose my invention and to convey its principles to others. No limits on the breadth of my patent rights based simply on using specific language are intended. Any alterations and modifications to this description that should normally occur to one of average skill in creating board games are also included.

Figure 1:
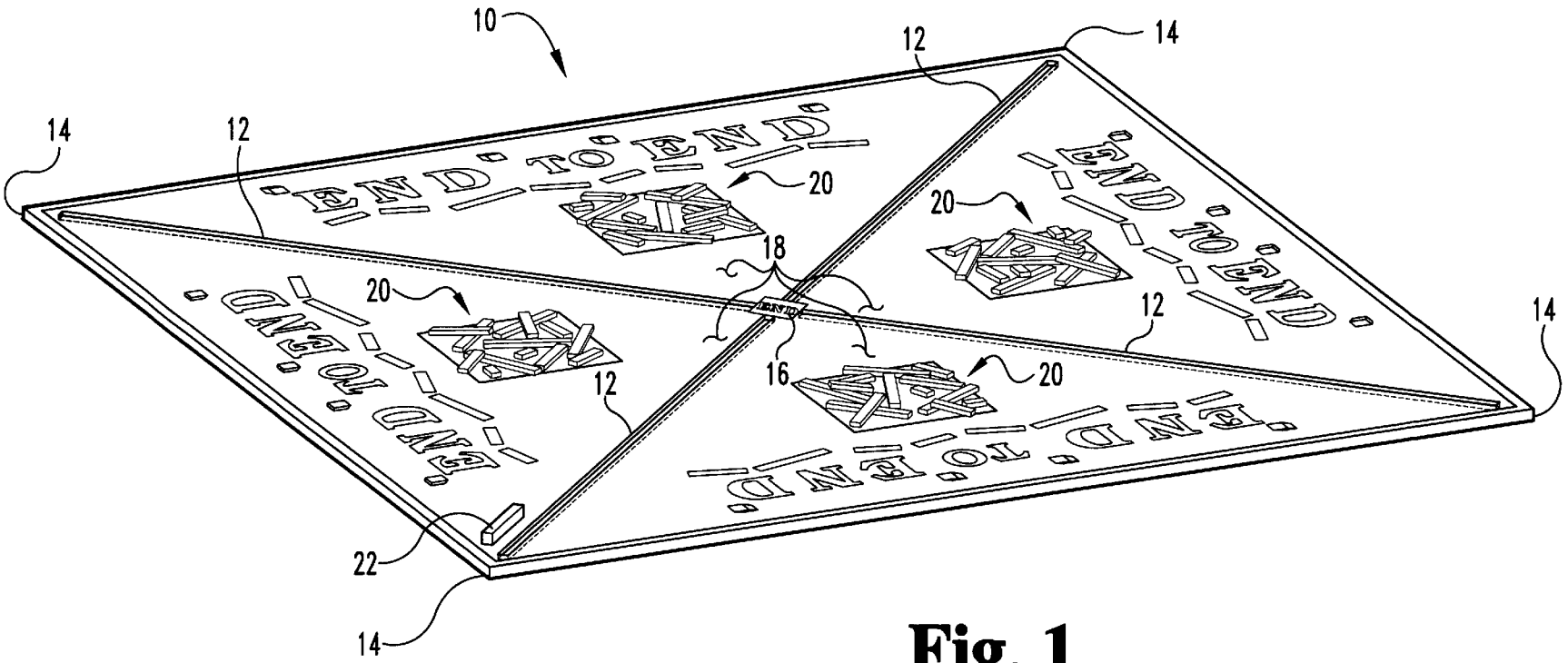
FIG. 1 is a perspective view of a game board embodiment of the present invention.

FIG. 1 illustrates a first preferred embodiment of the present invention. A game board 10 is shown consisting of a substantially flat square of rigid material with narrow slots 12 formed therein, running from the four corners 14 diagonally towards the center 16 of the board 10. The slots 12 are recessed into the board 10. The slots 12 define four triangular areas 18 on the board 10. A different dowel set 20 is located in each of the triangular areas 18. In this first preferred embodiment, each dowel set 20 has a different characteristic color and contains a plurality of dowels 22 of substantially identical lengths. The dowels 22 are adapted to fit loosely within the slots 12.

While the first preferred embodiment includes a rigid game board 10, other embodiments have flexible game "boards" made of vinyl, rubber or the like. Still other embodiments use an electronic video display screen or cathode ray tube (CRT) as a "board".

Moreover, while the first preferred embodiment recites slots recessed into the board 20, in other embodiments the slots 12 may be formed by painting or drawing them on the board 10. In these embodiments, the dowels 22 are not constrained to fit within the slots 12, but merely have to rest on top of them.

Furthermore, in the first preferred embodiment, there are four slots 12 located on the diagonals running from the corners 14 toward the center 16 of the board 10. In other embodiments, there are two, three, or more than four slots 12. In these other embodiments, the slots 12 are positioned in any convenient locations on the board 10. In still other embodiments, there are four slots 12 positioned other than diagonally from the corners 14 to the center 16 of the board 10.

FIG. 2 illustrates the different sizes of the dowels 22 in relation to one another in the first preferred embodiment. The shortest dowel 24 has a length of one unit 25, wherein one unit 25 is an arbitrary measure of length. The next shortest dowel 26 has a length of two units 25, while the next longest dowel 28 has a length of three units 25 and the longest dowel 30 has a length of four units 25. The lengths characteristic of each dowel set 20 are integral multiples of the shortest dowels 26. In other words, if two more dowel sets 20 were to be added, the lengths of the dowels 22 in the new sets would be five and six units 25, respectively. In the first preferred embodiment, the color of the shortest dowels 24 is red, the color of the next shortest dowels 26 is yellow, the color of the next longest dowels 28 is green, and the color of the longest dowels 30 is blue. It is understood that the color choice is arbitrary, and any colors may be assigned to the dowel sets 20.

While the dowels 22 in the first preferred embodiment have lengths that are integral multiples of the length of the shortest dowels 26, in other embodiments the dowels have integral length ratios based on a fraction of the length of the shortest dowel 26. For example, in one embodiment the dowels 22 have length ratios of 2:3:5:8, with the base unit of measure being half the length of the shortest dowel 26.

FIG. 3 shows a cross-sectional view of a dowel 22 filling a slot 12 in the game board 10 in the first preferred embodiment. The dowel 22 has a rectangular cross-section 36 to match the shape of the slot 12. It is noted that the cross-section of the dowel 22 may have any convenient shape, such as an oval, a circle, a hemisphere, a triangle, a hexagon, or the like.

FIG. 4 illustrates a first preferred embodiment of a dowel selection means 40. In this embodiment, the dowel selection means 40 is a six-sided die 42, with a red side 44, a yellow side 46, a green side 48 and a blue side 50 to match the colors of the dowel sets 20. The remaining two sides are a black side 52 and a white side 54.

In other embodiments, the dowel selection means 40 is a spinner. In still other embodiments, the dowel selection means 40 is electronic, such as a program to generate a random number. In embodiments having more than four slots 12, the dowel selection means 40 may be a spinner or a die having a number of sides equal to the number of slots plus two or any other convenient means.

Figure 5:
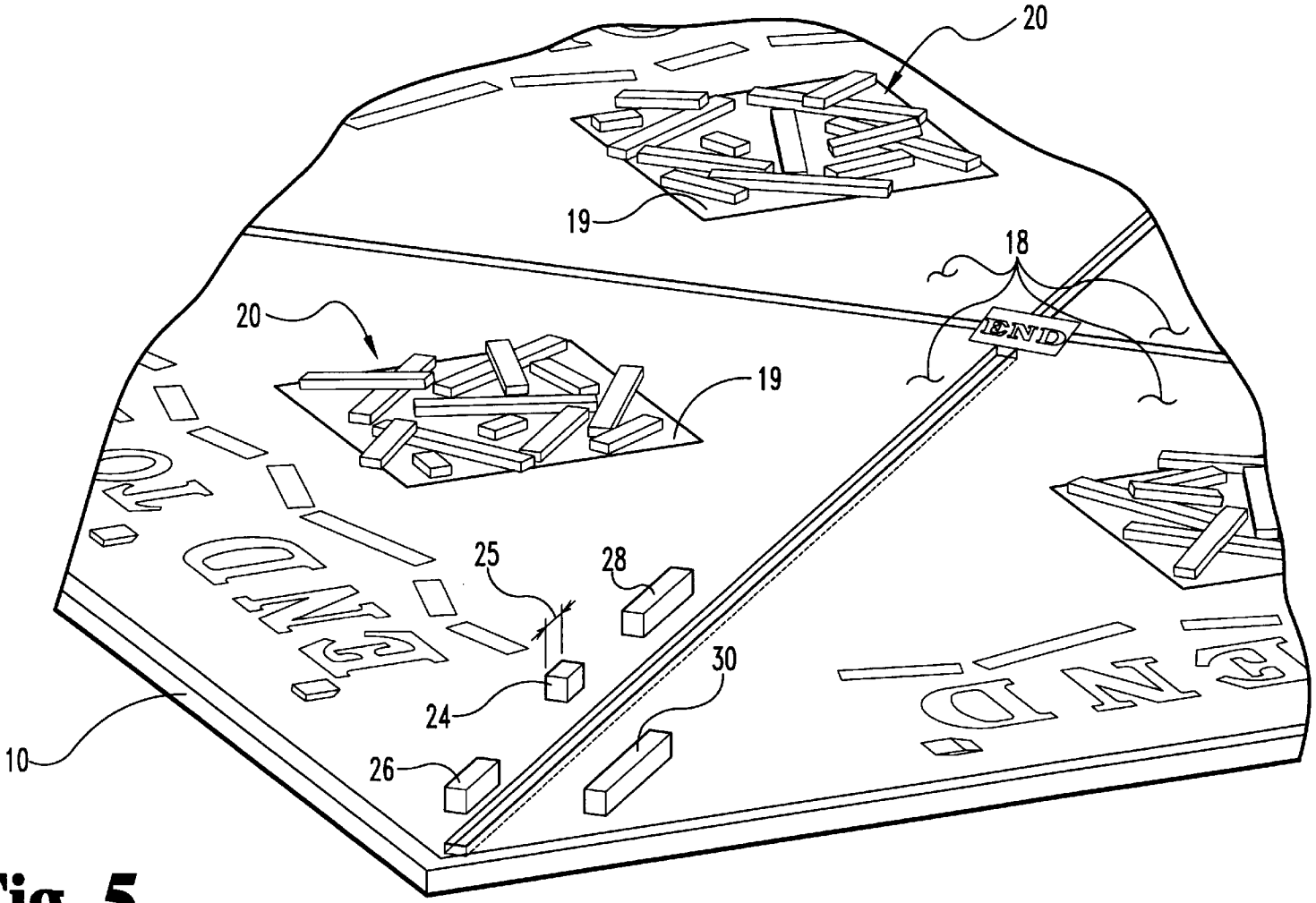
FIG. 5 is a partial perspective view of the game board embodiment of the present invention, illustrating the relationship of the dowel lengths to the slot length.
Figure 6:
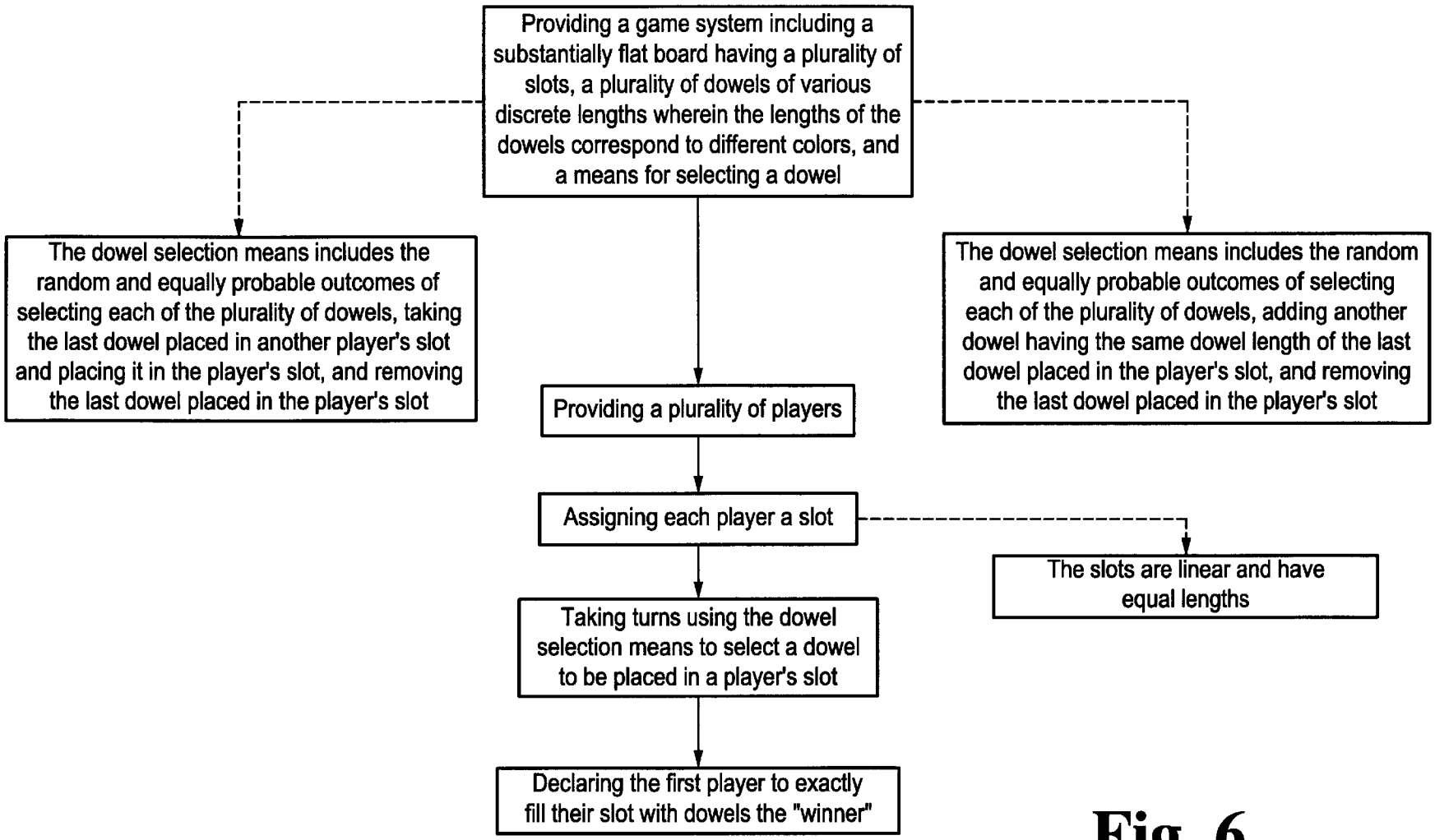
FIG. 6 is a flow chart illustrating one method of play of the present invention shown in FIG. 1.

FIG. 5 is a partial perspective view of the game board 10 of the first preferred embodiment of the present invention and illustrates the relation of the various lengths of the dowels 24, 26, 28 and 30 to the slots 12 in the board 10. The slot 12 is thirty-four times the length of the shortest dowel 24, or thirty-four units 25 long. This allows a game to take at least nine turns for completion, and usually more. The four triangular areas 18 each include a colored square 19. The four colored squares 19 are colored to correspond to the color of the dowel sets 20, red, yellow, green and blue, respectively. In embodiments featuring different colored dowel sets 20, the colored squares 19 will be colored accordingly.

Other embodiments include making the board 10 and/or slots 12 from a ferromagnetic material and the dowels 20 from strips of flexible magnetic material cut to various lengths. In this variation, the slots 12 can be either recessed into the board 10 or painted on the board 10. The board 10 can be either rigid or flexible. This embodiment is ideal for a portable version of the game.

METHODS OF PLAY

In the above-described preferred embodiment, the game can be played by two to four players. A player can be either an individual or a team. Each player chooses a slot 12 to fill. The order of play is determined by any convenient means, such as a toss of the die 42 to determine which player (here represented by a color for the purpose of determining play order) goes first. Each player takes a turn by rolling the die 42. If the color of a dowel set 20 comes up, the player adds a dowel 22 of that color to his slot 12. If the black side 52 comes up, the player removes the last dowel 22 added to his slot 12. If the white side 54 comes up, the player may take the last dowel 22 added to another player's slot 12 and place it in his own slot 12. If the dowel 22 to be added to the player's slot 12 exceeds the remaining empty space available in the slot 12, the turn passes to the next player. Play moves sequentially from player to player until one player completely fills his slot 12, thereby winning the game.

One variation of play includes the player adding a dowel 22 to his slot 12 from the same dowel set 20 as the last dowel 22 added to his slot 12 when the die 42 roll results in the white side 54 coming up, and the player loses a turn when black comes up. Another variation includes the player having to incorporate at least one dowel 20 from each dowel set 22 into his slot 12 in order to win the game. Of course, all of these rules and variations are merely suggestions. Many variations of the method of play using the board 10, dowel sets 20, and dowel selection means 40 are possible and will become apparent to those using the invention, particularly parents and teachers practicing the invention as a teaching tool.

While the invention has been illustrated and described in detail in the drawings and foregoing description, the same is to be considered as illustrative and not restrictive in character, it being understood that only the preferred embodiment has been shown and described in detail and that all changes and modifications that come within the spirit of the invention are desired to be protected.

What is claimed is:

1. A game, comprising:

a substantially flat and rectangular board having a plurality of slots of equal length formed therein and wherein each of said slots is located on a different diagonal that begins near the edge of said rectangular board and extends inwardly toward the center of said rectangular board;

a plurality of dowels having various dowel lengths, said dowels being adapted to fit into said slots; and means for selecting which dowel to place into a slot.

2. The game of claim 1 wherein said slots are about 34 times the length of the shortest dowel.

3. The game of claim 1 wherein there are four different dowel lengths having the ratios of 1:2:3:4.

4. The game of claim 3 wherein the dowels are colored corresponding to their lengths.

5. The game of claim 4 wherein the ratio of the slot length to the shortest dowel length is 34:1.

6. The game of claim 1 wherein the dowel selection means is a six-sided die.

7. The game of claim 1 wherein the dowel selection means is a spinner.

8. The game of claim 1 wherein the slots are comprised of a line painted on said rectangular board.

9. The game of claim 1 wherein the slots are recessed into the board.

10. The game of claim 1 wherein said slots do not intersect each other.

11. The game of claim 1 wherein said plurality of slots is four slots.

12. A method of playing a game comprising the steps of:

providing a game system, said same system including a substantially flat board having a plurality of linear slots radiating from the center of said board, a plurality of dowels of various discrete lengths, and a device for selecting a dowel of a particular length, said dowel selection device selected from the group consisting of a spinner and a die;

providing a plurality of players;

assigning each player a slot;

taking turns using the dowel selection device to select a dowel of a particular length to be placed in a player's slot; and declaring the first player to exactly fill their slot with dowels the "winner".

13. The method of claim 12 wherein the dowel selection device includes the random and equally probable outcomes of (a) selecting each of the plurality of dowels of a discrete length, (b) adding another dowel having the same dowel length of the last dowel placed in the player's slot, and (c) removing the last dowel placed in the player's slot.

14. The method of claim 12 wherein the dowel selection device includes the random and equally probable outcomes of (a) selecting each of the plurality of dowels of a discrete length, (b) removing the last dowel placed in another player's slot and placing it in the player's slot, and (c) removing the last dowel placed in the player's slot.

15. The method of claim 12 wherein the slots have equal lengths.

16. The method of claim 12 wherein said linear slots in said game system do not intersect each other.

* * * * *